US008771013B2

(12) United States Patent
Kalayjian et al.

(10) Patent No.: US 8,771,013 B2
(45) Date of Patent: Jul. 8, 2014

(54) HIGH VOLTAGE CABLE CONNECTOR

(75) Inventors: Nicholas Robert Kalayjian, San Carlos, CA (US); Dino Sasaridis, San Francisco, CA (US); Benjamin David Dettmann, San Francisco, CA (US)

(73) Assignee: Tesla Motors, Inc., Palo Alto, CA (US)

( * ) Notice: Subject to any disclaimer, the term of this patent is extended or adjusted under 35 U.S.C. 154(b) by 155 days.

(21) Appl. No.: 13/523,720

(22) Filed: Jun. 14, 2012

(65) Prior Publication Data

US 2013/0337705 A1 Dec. 19, 2013

(51) Int. Cl.
*H01R 9/05* (2006.01)

(52) U.S. Cl.
USPC ..... 439/585; 439/587; 439/878

(58) Field of Classification Search
USPC ..... 439/585, 587, 668, 274, 275
IPC ..... H01R 13/5208,9/0518, 9/032, 9/05
See application file for complete search history.

(56) References Cited

U.S. PATENT DOCUMENTS

| | | | | |
|---|---|---|---|---|
| 6,464,538 | B2 * | 10/2002 | Miyazaki et al. | 439/607.44 |
| 6,583,352 | B2 * | 6/2003 | Fukushima et al. | 174/373 |
| 6,945,817 | B2 * | 9/2005 | Miyazaki et al. | 439/579 |
| 7,048,562 | B2 * | 5/2006 | Lutsch et al. | 439/275 |
| 7,931,498 | B2 * | 4/2011 | Skeels et al. | 439/578 |
| 2013/0084738 | A1 * | 4/2013 | Van Swearingen et al. | 439/578 |

* cited by examiner

*Primary Examiner* — Hien Vu
(74) *Attorney, Agent, or Firm* — J. Richard Soderberg

(57) ABSTRACT

A system and method for a shielded coaxial cable including a collar including a cylindrical housing having a cylindrical inner bore, the inner bore having top and bottom openings the top opening having a diameter about equal to an outer diameter of an outer insulating layer of the cable and the bottom opening having a diameter about equal to an outer diameter of a shield layer of the cable with a terminating portion of the shield layer exposed and returned over an exterior portion of said collar near the bottom opening with the terminating portion overlapping said exterior portion; and a termination ferrule joined to the terminating portion that overlaps the exterior portion to simultaneously provide an electrical communication between the shield layer and the collar and provide a strain relief for the shielded cable disposed within the inner bore.

18 Claims, 5 Drawing Sheets

HIGH VOLTAGE CABLE CONNECTOR

BACKGROUND OF THE INVENTION

The present invention relates generally to shielded cable termination, and more specifically, but not exclusively, to a single connector providing environmental protection, strain relief, and cable shield termination to a high voltage shielded coaxial cable.

In the assembly of many types of electrical equipment, it is common to use shielded cables. In general, these are electrical cables having one or more insulated conductors sheathed in a common conductive layer referred to as the shield. This shield is typically composed of braided strands of metal (e.g., copper or aluminum). These shielded cables are used with termination systems designed to provide both electrical and mechanical interface functions.

Conventional systems are built using detachable connectors or bolted connections that may include a gland-type enclosure seal, often with the electrical interface and the mechanical interface provided as discrete elements. Providing conventional-style environmental protection, strain relief, and cable shield termination with the termination system often uses many parts joined with multiple crimping operations. As the number of parts and the number of crimping operations for terminating a shielded cable decreases, reliability improves and costs decrease.

What is needed is a system and method that improves reliability and cost-effectiveness of shielded cable termination systems.

BRIEF SUMMARY OF THE INVENTION

Disclosed is a system and method that improves reliability and cost-effectiveness of shielded cable termination systems. Strategic orientation of elements of a termination collar allows many advantages including an arrangement where a single joining action (e.g., crimping and the like) that provides electrical termination of the shield portion of a shielded cable also physically engages the cable to provide strain relief. Other features of the collar provide any additional needed or desired electro-mechanical interface functions.

The following summary of the invention is provided to facilitate an understanding of some of technical features related to shielded cable termination systems, and is not intended to be a full description of the present invention. A full appreciation of the various aspects of the invention can be gained by taking the entire specification, claims, drawings, and abstract as a whole. The present invention is applicable to other termination systems besides those used for shielded cable termination in an electric vehicle.

A termination system for a shielded cable including a main conductor, an inner insulating layer, a shield layer and an outer insulating layer, including a collar including a generally cylindrical housing provided with a generally cylindrical inner bore, the inner bore having a top opening and a bottom opening, the top opening having a diameter about equal to an outer diameter of the outer insulating layer and the bottom opening having a diameter about equal to an outer diameter of the shield layer wherein the shielded cable including the outer insulating layer enters into the top opening and wherein the shielded cable excluding the outer layer exits the bottom opening with a terminating portion of the shield layer exposed and returned over an exterior portion of the collar proximate the bottom opening with the terminating portion overlapping the exterior portion; and a termination ferrule joined to the terminating portion that overlaps the exterior portion and simultaneously provides an electrical communication between the shield layer and the collar and provides a strain relief for the shielded cable disposed within the inner bore.

A method for terminating a shielded cable including a main conductor, an inner insulating layer, a shield layer and an outer insulating layer, the method including a) removing an end portion of the outer insulating layer from the shielded cable which exposes a terminating portion of the shield layer; b) inserting the end portion through a generally cylindrical inner bore of a generally cylindrical metal collar, the inner bore having a top opening and a bottom opening, the top opening having a diameter about equal to an outer diameter of the outer insulating layer and the bottom opening having a diameter about equal to an outer diameter of the shield layer; c) folding the terminating portion back over an exterior portion of the collar proximate the bottom opening where the terminating portion exits, with the terminating portion overlapping the exterior portion; d) placing a terminating ferrule over the terminating portion that overlaps the exterior portion; and thereafter; e) joining the terminating ferrule to the terminating portion in such a way as to simultaneously provide an electrical communication between the shield layer and the collar and a strain relief for the shielded cable disposed within the inner bore.

A termination system for a pair of shielded cables electrically coupled to a pair of contacts through an enclosure wall, each shielded cable including a main conductor, an inner insulating layer, a shield layer and an outer insulating layer, including a pair of collars, one for each shielded cable, each collar including a generally cylindrical housing provided with a generally cylindrical inner bore, the inner bore having a top opening and a bottom opening, the top opening having a diameter about equal to an outer diameter of the outer insulating layer and the bottom opening having a diameter about equal to an outer diameter of the shield layer wherein the shielded cable including the outer insulating layer enters into the top opening and wherein the shielded cable excluding the outer layer exits the bottom opening with a terminating portion of the shield layer exposed and returned over an exterior portion of the collar proximate the bottom opening with the terminating portion overlapping the exterior portion; and a pair of termination ferrules, one termination ferrule for an associated one of the pair of collars, each termination ferrule joined to the terminating portion that overlaps the exterior portion of the associated collar and simultaneously providing an electrical communication between the shield layer and the associated collar and providing a strain relief for the shielded cable disposed within the inner bore of the associated collar; wherein the enclosure wall includes a pair of cylindrical bores, each bore associated with one of the contacts; wherein each collar is seated at a seating reference in a different one cylindrical bore provided in the enclosure wall; wherein a first distance from the collar seating reference of a first cylindrical bore to the first contact is different from a second distance from the collar seating reference of a second cylindrical bore to the second contact; wherein a first shielded cable configured for connection to the first contact through the first cylindrical bore has a first length of the main conductor extending from the first collar associated with the first shielded cable sufficient to engage the first contact when the first collar is seated at the collar seating reference of the first cylindrical bore; wherein a second shielded cable configured for connection to the second contact through the second cylindrical bore has a second length of the main conductor extending from the second collar associated with the second shielded cable sufficient to engage the second contact when the second collar is seated at the collar seating reference of the second cylindrical bore; wherein the first length of the main conductor is unable to engage the second contact when the first collar is seated in the second cylindrical bore; and wherein the second length of the main conductor is unable to engage the first contact when the second collar is seated in the first cylindrical bore.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

Embodiments of the present invention provide a system and method that improves reliability and cost-effectiveness of shielded cable termination systems. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein. Reliable and cost-effective termination of shielded cable is important in many applications, but particularly so for termination of the high voltage cables used in electric vehicles (EVs). The following example describes the present invention in the context of EV cable termination to simplify the discussion as an aid in understanding. The present invention is not limited to such use.

Figure 1:
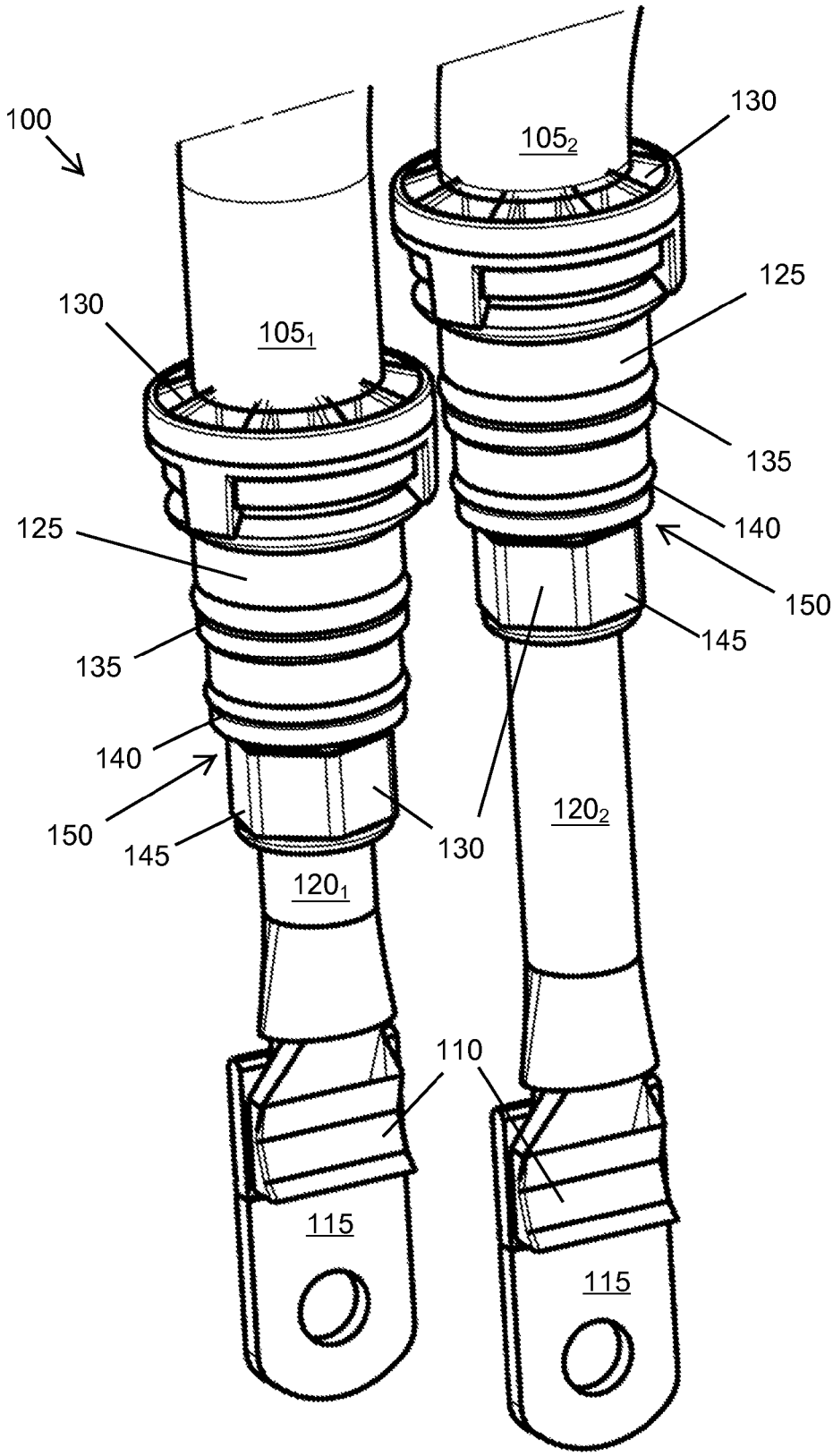
FIG. 1 illustrates a termination system used with a pair of high voltage shielded cables.

FIG. 1 illustrates a termination system 100 used with a pair of high voltage shielded cables 105. Each high voltage shielded cable 105 includes a main conductor 110 attached to a terminal 115. The specifics of terminal 115 and the method of attachment to main conductor 110 are generally not central to the present invention. High voltage shielded cable 105 further includes an inner insulating layer 120 surrounding main conductor 110 as it extends from a collar 125. A position of each collar 125 is fixed physically on high voltage shielded cable 105, this position determining a distance main conductor 110 extends from collar 125. Fixing the position of each collar 125 on high voltage shielded cable 105 with differing specified distances for main conductor 110 aids in decreasing mis-assembly by helping to ensure that the correct cable is installed in the correct location (because terminal 115 will not align with a mating connection when installed at an incorrect location).

Each collar 125 is round, made of metal, and includes any necessary or desirable environmental protection and electrical termination features for high voltage shielded cable 105. Collar 125 is designed to physically interface to a complementary mating structure (e.g., a housing, enclosure wall, or the like) that includes a simple round bore. Not only does the round geometry reduce manufacturing costs for collar 125 and the mating bore, it simplifies assembly and reduces assembly and installation costs for several reasons, one of which is that terminal 115 has no specific relative angular position requirement relative to high voltage shielded cable 105 and to collar 125.

Environmental protection includes one or more of a cable-collar seal 130 or an environmental-collar seal 135. Cable-collar seal 130 provides an interior environmental control by radially sealing a portion of collar 125 to an insulating jacket layer of cable 105 to prevent/inhibit ingress of fluids (e.g., liquids and/or gases). Cable-collar seal 130 may be made of conventional materials and is retained within the top of collar 125 in a desired fashion to provide the desired level of environmental protection inside collar 125. For example, cable-collar seal 130 may be retained using a separate clip or an integrated retention feature (e.g., a one-way snap or ramp provided in the top opening). In other cases, the retention feature may be formed after cable-collar seal 130 is installed, such as by compression or other mechanical process after cable-collar seal 130 is installed into collar 125.

Environmental-collar seal 135 provides an exterior environmental control by sealing a body portion of collar 125 to prevent/inhibit flow of fluids (e.g., liquids and/or gases) around an outside of collar 125 (e.g., between collar 125 and the complementary mating structure). Environmental-collar seal 135 may be made of conventional materials (e.g., an "O" ring or the like) and is retained within a collar channel provided in an exterior wall of the body portion to provide the desired level of environmental protection between collar 125 and the complementary mating structure. Note that environmental-collar seal 135 may be a serviceable "O" ring rather than a more expensive overmolded seal since termination system 100 is generally cylindrical.

Collar 125 may provide any necessary/desired electrical interface (e.g., a shield termination) to the complementary mating structure by use of an exterior electrical contact 140 disposed within a collar groove in the exterior wall, the collar groove inboard (i.e., towards terminal 115) from the collar channel that locates environmental-collar seal 135. Exterior electrical contact 140 provides an electrical contact between the body of collar 125 and the mating structure into which collar 125 is installed. Collar 125 slides axially with the complementary mating structure to provide assembly tolerance flexibility. Environmental-collar seal 135 mates to complementary sealing surface inside the circular bore that is part of the complementary mating structure. An outer diameter of exterior electrical contact 140 is less than an outer diameter of environmental-collar seal 135 which helps protect the complementary sealing surface from damage by exterior electrical contact 140 during installation. Exterior electrical contact 140 may be made of conventional materials (e.g., a metal coil spring or the like) and is retained within the collar groove on the body portion to provide the desired level of electrical coupling between collar 125 and the complementary mating structure.

A termination ferrule 145 connects a shield of a shield layer of high voltage shielded cable 105 to collar 125. In a preferred embodiment, termination ferrule 145 may be a simple extruded tube that is manufactured at very low cost. Termination ferrule is slid over an end of main conductor 110 and inner insulating layer 120 prior to fixing terminal 115. Termination ferrule 145 is located properly along inner insulating layer 120 by use of an exterior stop 150 on the exterior wall of collar 125. After termination ferrule 145 is located, it is crimped which simultaneously connects collar 125 to the shield and physically locks collar 125 in place on high voltage shielded cable 105. Physical placement is achieved by deforming the body portion and compressing collar 125 against an insulating portion of high voltage shielded cable 105 that passes through a central bore of collar 125. This deformation and compression provides strain relief for high voltage shielded cable 105. In the context of collar 125, the term strain relief refers to an ability to pull on the cable without compromising one or more features (e.g., seal integrity and/or mechanical/electrical interface quality) of termination system 100 beyond a predetermined threshold.

Figure 2:
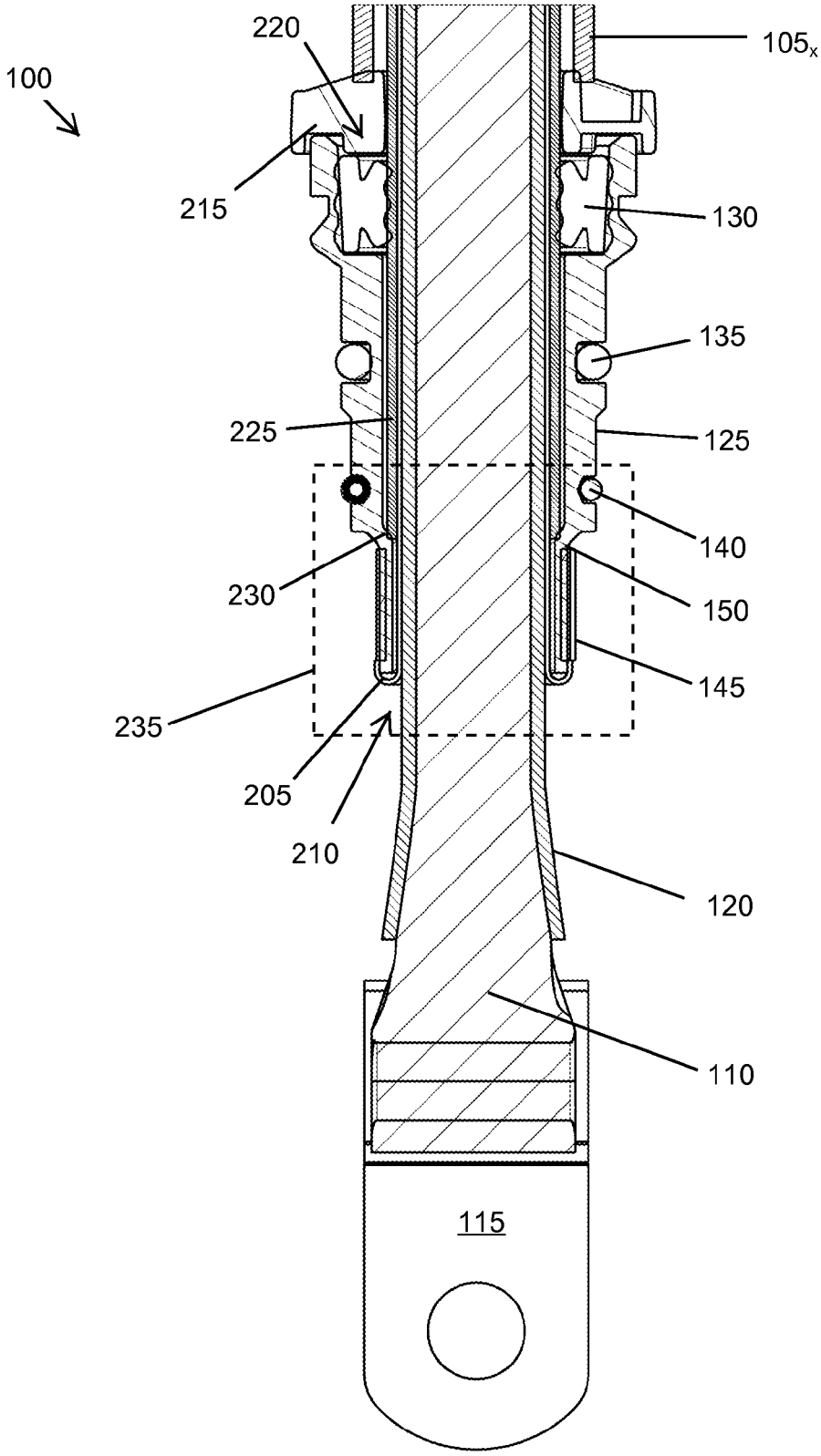
FIG. 2 illustrates a sectional view of the termination system shown in FIG. 1.

FIG. 2 illustrates a sectional view of the termination system shown in FIG. 1. High voltage shielded cable $\mathbf{105}_x$ includes a shield 205 (e.g., a braided metal mesh of copper or aluminum or the like) that extends out of, and is folded/returned over, a bottom opening 210 of collar 125. Termination ferrule 145 is installed over folded shield 205 and crimped, which forms the electric contact between shield 205 and collar 125. Preferably folded back portion of exposed shield 205 extends a significant distance under crimped termination ferrule 145. Exterior electrical contact 140, when contacting the interior of the complementary mating structure, thus electrically communicates shield 205 to the complementary mating structure, providing an electrical termination/ground for shield 205. As also shown in FIG. 2, a retaining clip 215 holds cable-collar seal 130 in place inside a top opening 220 of collar 125, radially sealing an inside wall portion of collar 125 against an exterior insulating jacket layer 225 of high voltage shielded cable $\mathbf{105}_x$.

The interior bore of collar 125 includes an interior stop 230 for mechanical interface to exterior insulating jacket layer 225. High voltage electrical cable 105 is specified to have different lengths of the various layers pre-processed (e.g., cut), and when pre-processed correctly, collar 125 is easily and simply installed. The different layers of high voltage shielded cable $\mathbf{105}_x$ are serially exposed in a tiered progression from a proximal portion inside collar 125 towards a distal portion near terminal 115. That is, high voltage shielded cable $\mathbf{105}_x$ includes a first portion in which exterior insulating jacket layer 225 ends and shield 205 is exposed. There is a second portion having the exposed shield 205 of a sufficient length enabling it to a) extend out of bottom opening 210 and b) be folded back over a portion of collar 125 near bottom opening 210. There is a third portion extending from the end of the exposed shield 205 to the distal end proximate terminal 115 which is covered with inner insulating layer 120, and finally there is a fourth portion including the exposed main conductor 110 at the distal end.

Figure 3:
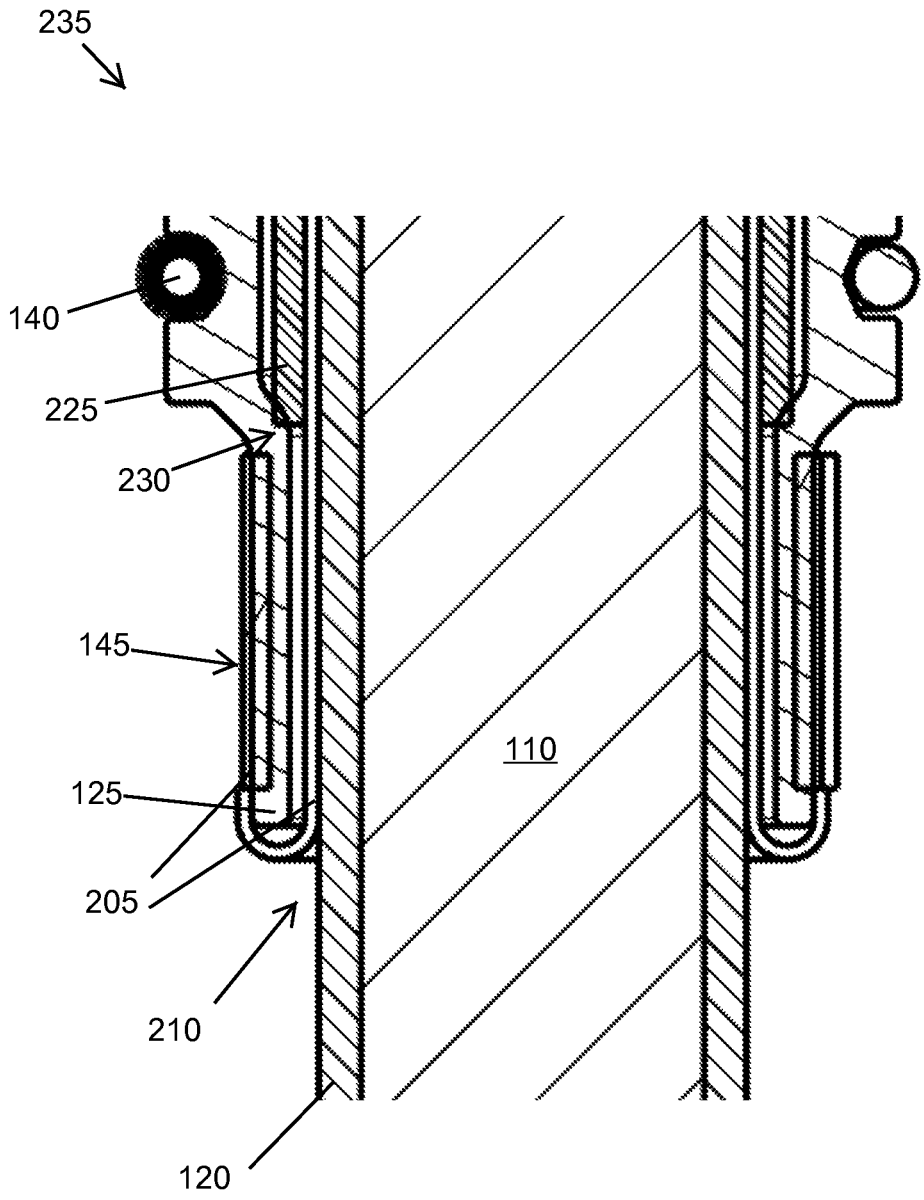
FIG. 3 illustrates a detail view of a shield termination/strain relief portion of the termination system shown in FIG. 2.

An important feature for the interior bore of collar 125 is that it includes a critical narrowing taper at interior stop 230. This taper facilitates insertion of the exposed portion of shield 205 into collar 125 and out of bottom opening 210 without damage. An inner diameter of the interior bore of collar 125 at interior stop 230 where the narrowing taper begins must not be too great or it will not provide the stop when acting against a terminating edge of exterior insulating jacket layer 225. Neither can the inner diameter be too small or it will contact the exposed portion of shield 205 causing it to bunch, tear, or gather inside collar 125. An inner diameter of the interior bore of collar 125 at interior stop 230 where the narrowing taper ends is preferably as small as possible while permitting shield 205 to exit. A smaller diameter for the taper reduces an amount of distortion/compression required of collar 125 when crimping termination ferrule 145 to provide the desired cable strain relief. FIG. 3 illustrates a detail view of a shield termination/strain relief portion 235 of the termination system shown in FIG. 2.

Figure 4:
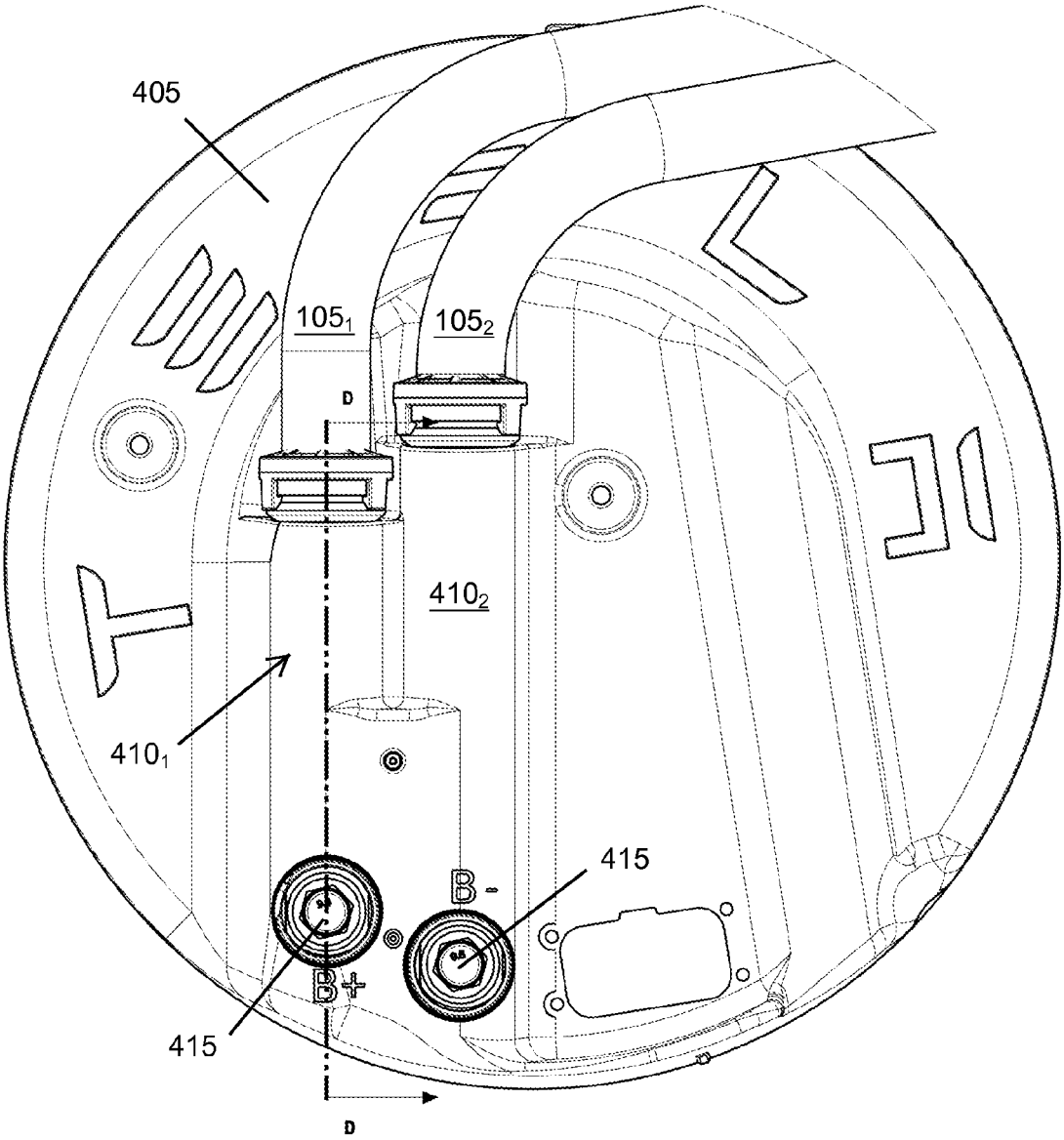
FIG. 4 illustrates the terminated pair of high voltage shielded cables mounted within a housing.
Figure 5:
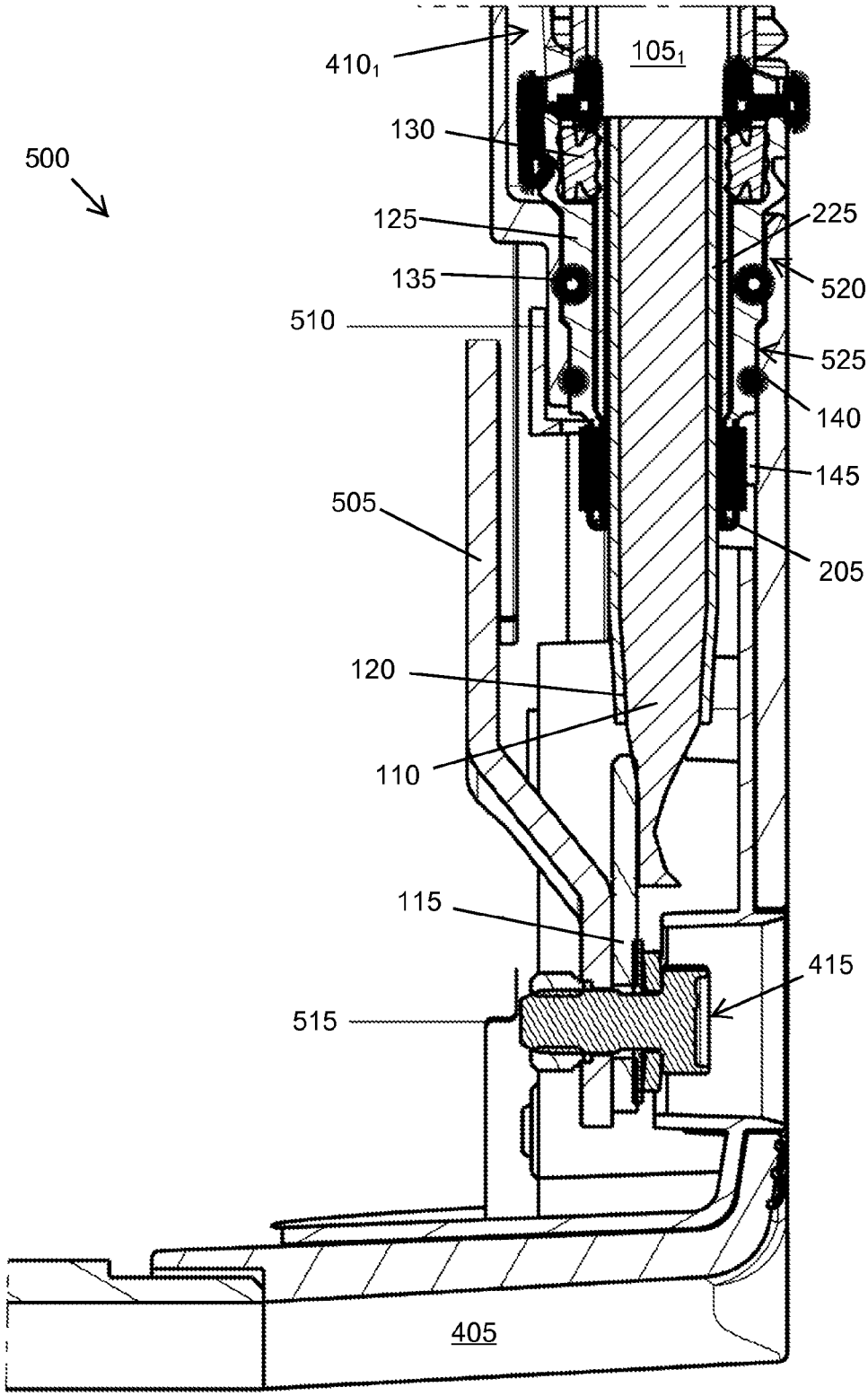
FIG. 5 illustrates a sectional view of one of the mounted terminated high voltage shielded cables of FIG. 4.

FIG. 4 illustrates the terminated pair of high voltage shielded cables 105 of FIG. 1 mounted in a housing 405; and FIG. 5 illustrates a sectional view (D-D) of a portion 500 of one of the mounted terminated high voltage shielded cables $\mathbf{105}_1$ of FIG. 4 installed within a bore $\mathbf{410}_1$ of housing 405. Housing 405 includes a pair of bores 410, each receiving and mating to an associated collar 125 of a respective one of the pair of high voltage shielded cables. In a preferred implementation, collar 125 does not include any independent mechanical interlock for retention within its associated bore 410. Physical retention of high voltage shielded cable 105, within housing 405 is provided by engaging terminal 115 with a fastener 415 to attach to a desired termination, for example a busbar 505. As shown in FIG. 4, high voltage shielded cable $\mathbf{105}_1$ is coupled to a positive terminal of a battery (B+) and high voltage shielded cable $\mathbf{105}_2$ is coupled to a negative terminal of the battery (B−). The different lengths of main conductor 110 extending out of bottom opening 210 for the two terminated shielded cables 105 ensures that the high voltage cables cannot be attached to incorrect terminals. A distance between a reference point 510 on collar 125 and a reference point 515 on terminal 115 sets a poka-yoke length of main conductor 110.

Collectively with the poka-yoke lengths, all the cables of a collection cannot be mis-assembled. While a longer assembly may be mis-connected at a location designed for a shorter assembly, a remaining shorter assembly will be incapable of being connected at the remaining location designed for the longer assembly. The poka-yoke length differences are set large enough that assembly tolerance stack-up does not allow incorrect assembly. In the disclosed embodiments where the poka-yoke lengths are set by the crimping of termination ferrule 145, the crimp is effective to maintain the positional differences of joinder of collar 125 to cable 105 among the collection.

Collar 125 provides the environmental protection and electrical termination by appropriate interaction within its associated bore $\mathbf{410}_x$. Bore $\mathbf{410}_1$ includes an interior environmental seal portion 520 and an interior electrical interface portion 525. Interior environmental seal portion 520 is sized and configured to engage environmental-collar seal 135 for desired weather seal properties (e.g., prevent water from entering into housing 405). Interior electrical interface portion 525 is sized and configured to engage exterior electrical contact 140 for desired electrical properties (e.g., electrical connection of shield 205 to housing 405). An inner diameter of interior environmental seal portion 520 is greater than an interior diameter of interior electrical interface portion 525 to help prevent exterior electrical contact 140 from damaging/degrading interior environmental seal portion 520 as collar 125 is installed into bore 410. The greater a cycle life, the more that this concern is relevant.

The systems and methods above has been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A termination system for a shielded cable including a main conductor, an inner insulating layer, a shield layer and an outer insulating layer, comprising:

a collar including a generally cylindrical housing provided with a generally cylindrical inner bore, said inner bore having a top opening and a bottom opening, said top opening having a diameter about equal to an outer diameter of the outer insulating layer and said bottom opening having a diameter about equal to an outer diameter of the shield layer wherein the shielded cable including the outer insulating layer enters into said top opening and wherein the shielded cable excluding the outer insulating layer exits said bottom opening with a terminating portion of the shield layer exposed and returned over an exterior portion of said collar proximate said bottom opening with said terminating portion overlapping said exterior portion; and a termination ferrule joined to said terminating portion that overlaps said exterior portion and provides an electrical communication between the shield layer and said collar, the termination ferrule being securely fitted onto the exterior portion so as to provide a strain relief for the shielded cable disposed within said inner bore.

2. The termination system of claim 1 wherein said termination ferrule includes an extruded sleeve portion overlying said overlapping exterior portion and said terminating portion.

3. The termination system of claim 2 wherein said extruded sleeve portion is crimped to said collar at said bottom opening.

4. The termination system of claim 3 wherein said collar, responsive to said crimping of said extruded sleeve portion, is compressed proximate said bottom opening to such degree that said collar engages the shield layer inside said inner bore to provide said strain relief.

5. The termination system of claim 1 wherein said inner bore further defines a cable stop at an intermediate point between said top opening and said bottom opening wherein said cable stop includes a generally annular transition between a first inner diameter and a second inner diameter, said second inner diameter smaller than said first inner diameter, with said first inner diameter not larger than said diameter of said top opening and said second inner diameter smaller than said outer diameter of the outer insulating layer and not smaller than said diameter of said bottom opening.

6. The termination system of claim 5 wherein said second inner diameter is larger than said diameter of said bottom opening.

7. The termination system of claim 1 further comprising an exterior annular environmental seal coupled to a first exterior portion of said collar.

8. The termination system of claim 7 exterior annular environmental seal includes an O-ring seal.

9. The termination system of claim 1 wherein said collar is made of metal and further comprising an exterior annular electrical contact coupled to an exterior portion of said collar.

10. The termination system of claim 7 wherein said collar is made of metal and further comprising an exterior annular electrical contact coupled to a second exterior portion of said collar.

11. The termination system of claim 10 wherein second exterior portion is disposed between said first exterior portion and said bottom opening.

12. The termination system of claim 11 wherein said exterior annular environmental seal has a diameter greater than a diameter of said exterior annular electrical contact.

13. The termination system of claim 1 further comprising an interior annular seal disposed at said top opening and sealing said collar to the exterior insulating layer entering into said top opening.

14. A method for terminating a shielded cable including a main conductor, an inner insulating layer, a shield layer and an outer insulating layer, the method comprising:

a) removing an end portion of the outer insulating layer from the shielded cable which exposes a terminating portion of the shield layer;

b) inserting said end portion through a generally cylindrical inner bore of a generally cylindrical metal collar, said inner bore having a top opening and a bottom opening, said top opening having a diameter about equal to an outer diameter of the outer insulating layer and said bottom opening having a diameter about equal to an outer diameter of the shield layer;

c) folding said terminating portion back over an exterior portion of said collar proximate said bottom opening where said terminating portion exits, with said terminating portion overlapping said exterior portion;

d) placing a terminating ferrule over said terminating portion that overlaps said exterior portion; and thereafter;

e) joining said terminating ferrule to said terminating portion in such a way as to provide an electrical communication between the shield layer and said collar, the termination ferrule being securely fitted onto the exterior portion so as to provide a strain relief for the shielded cable disposed within said inner bore.

15. The shielded cable terminating method of claim 14 wherein said terminating ferrule includes an extruded cylindrical sleeve and wherein said joining step e) includes:

e1) covering said terminating portion with said extruded cylindrical sleeve; and thereafter e2) crimping said extruded cylindrical sleeve to make electrical contact between the shield layer and said collar and to deform the bottom opening to compress said collar against the shielded cable within said inner bore.

16. The shielded cable terminating method of claim 14 wherein said collar includes an exterior electrical contact disposed on an exterior portion of said collar with said exterior electrical contact electrically coupled to said collar, the method further comprising:

f) inserting said collar through a cylindrical bore provided through an enclosure wall; and thereafter g) coupling electrically said enclosure wall to the shield layer by engaging an inner surface of said cylindrical bore with said exterior electrical contact automatically during said inserting step f).

17. The shielded cable terminating method of claim 16 wherein a main conductor extending from said bottom opening is electrically coupled to a terminal configured for a physical connection to a contact, the method further comprising:

h) retaining said collar within said cylindrical bore responsive to said physical connection to said contact without said collar including a locking system engaging said enclosure wall.

18. A termination system for a pair of shielded cables electrically coupled to a pair of contacts through an enclosure wall, each shielded cable including a main conductor, an inner insulating layer, a shield layer and an outer insulating layer, comprising:

a pair of collars, one for each shielded cable, each collar including a generally cylindrical housing provided with a generally cylindrical inner bore, said inner bore having a top opening and a bottom opening, said top opening having a diameter about equal to an outer diameter of the outer insulating layer and said bottom opening having a diameter about equal to an outer diameter of the shield layer wherein the shielded cable including the outer insulating layer enters into said top opening and wherein the shielded cable excluding the outer insulating layer exits said bottom opening with a terminating portion of the shield layer exposed and returned over an exterior portion of said collar proximate said bottom opening with said terminating portion overlapping said exterior portion; and a pair of termination ferrules, one termination ferrule for an associated one of said pair of collars, each termination ferrule joined to said terminating portion that overlaps said exterior portion of said associated collar and providing an electrical communication between the shield layer and said associated collar, the termination ferrule being securely fitted onto the exterior portion so as to provide a strain relief for the shielded cable disposed within said inner bore of said associated collar;

wherein the enclosure wall includes a pair of cylindrical bores, each bore associated with one of the contacts;

wherein each collar is seated at a seating reference in a different one cylindrical bore provided in the enclosure wall;

wherein a first distance from said collar seating reference of a first cylindrical bore to the first contact is different from a second distance from said collar seating reference of a second cylindrical bore to the second contact;

wherein a first shielded cable configured for connection to the first contact through said first cylindrical bore has a first length of the main conductor extending from said first collar associated with said first shielded cable sufficient to engage the first contact when said first collar is seated at said collar seating reference of said first cylindrical bore;

wherein a second shielded cable configured for connection to the second contact through said second cylindrical bore has a second length of the main conductor extending from said second collar associated with said second shielded cable sufficient to engage the second contact when said second collar is seated at said collar seating reference of said second cylindrical bore;

wherein said first length of the main conductor is unable to engage the second contact when said first collar is seated in said second cylindrical bore; and wherein said second length of the main conductor is unable to engage the first contact when said second collar is seated in said first cylindrical bore.

* * * * *